US011056254B2

(12) United States Patent
Fujita et al.

(10) Patent No.: US 11,056,254 B2
(45) Date of Patent: Jul. 6, 2021

(54) METHOD OF MANUFACTURING MAGNETIC MATERIAL

(71) Applicants: Asaya Fujita, Aichi (JP); Kimihiro Ozaki, Aichi (JP)

(72) Inventors: Asaya Fujita, Aichi (JP); Kimihiro Ozaki, Aichi (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 579 days.

(21) Appl. No.: 15/767,427

(22) PCT Filed: Oct. 18, 2016

(86) PCT No.: PCT/JP2016/080883
§ 371 (c)(1),
(2) Date: Apr. 11, 2018

(87) PCT Pub. No.: WO2017/069131
PCT Pub. Date: Apr. 27, 2017

(65) Prior Publication Data

US 2018/0301254 A1 Oct. 18, 2018

(30) Foreign Application Priority Data

Oct. 19, 2015 (JP) ..... JP2015-205863

(51) Int. Cl.
*H01F 1/01* (2006.01)
*B22F 1/00* (2006.01)
(Continued)

(52) U.S. Cl.
CPC ..... *H01F 1/01* (2013.01); *B22F 1/0003* (2013.01); *B22F 1/0088* (2013.01); *C22C 38/00* (2013.01);
(Continued)

(58) Field of Classification Search
CPC ..... H01F 1/015
See application file for complete search history.

(56) References Cited

U.S. PATENT DOCUMENTS

2004/0079446 A1 4/2004 Kogure et al.
2004/0194855 A1 10/2004 Fukamichi et al.
(Continued)

FOREIGN PATENT DOCUMENTS

EP 1867744 12/2007
EP 2508279 10/2012
(Continued)

OTHER PUBLICATIONS

Paul Johnson, "Furnace Atmospheres," ASM Handbook vol. 4 (1991), pp. 542-567 (hereinafter"Johnson").*
(Continued)

*Primary Examiner* — Christopher S Kessler
(74) *Attorney, Agent, or Firm* — IPUSA, PLLC

(57) ABSTRACT

A method of manufacturing a magnetic material, includes a surface oxides decreasing step of decreasing surface oxides of an iron powder; a powder-molded body forming step of mixing the iron powder whose surface oxides are already decreased obtained by the surface oxides decreasing step, and a compound powder "A" constituted by a La element and a Si element, and compressing and molding the obtained mixture powder; and a sintered body forming step of preparing a sintered body from the powder-molded body obtained by the powder-molded body forming step, by a solid phase reaction under vacuum atmosphere.

3 Claims, 5 Drawing Sheets

(51) Int. Cl.

| | |
|---|---|
| ***C22C 38/00*** | (2006.01) |
| ***C22C 38/02*** | (2006.01) |
| ***H01F 41/02*** | (2006.01) |
| *B22F 9/04* | (2006.01) |

(52) U.S. Cl.

CPC ..... *C22C 38/005* (2013.01); *C22C 38/02* (2013.01); *H01F 1/015* (2013.01); *H01F 41/026* (2013.01); *H01F 41/0266* (2013.01); *B22F 9/04* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 2005/0000230 | A1 | 1/2005 | Saito et al. | |
| 2006/0213580 | A1 | 9/2006 | Tsuji et al. | |
| 2006/0254385 | A1* | 11/2006 | Tsuji ..... | H01F 1/015 75/244 |
| 2010/0047527 | A1* | 2/2010 | Katter ..... | H01F 1/015 428/172 |
| 2015/0047371 | A1 | 2/2015 | Hu et al. | |

FOREIGN PATENT DOCUMENTS

| | | |
|---|---|---|
| JP | 2002-356748 | 12/2002 |
| JP | 2003-096547 | 4/2003 |
| JP | 2004-099928 | 4/2004 |
| JP | 2004-100043 | 4/2004 |
| JP | 2005-113209 | 4/2005 |
| JP | 2006-265631 | 10/2006 |
| JP | 2006-274345 | 10/2006 |
| JP | 2006-316324 | 11/2006 |
| JP | 2016/080883 | 12/2016 |

OTHER PUBLICATIONS

Lampman, Compressibility and Compactibility of Metal Powders, ASM Handbook vol. 7 (1998), pp. 302-309.*

Michael L. Marucci and James A. Catanese, "Production of Powder Metallurgy Carbon and Low-Alloy Steels" ASM Handbook vol. 7 (2015), pp. 311-321.*

Henrique N. Bez et al: "Magnetocaloric effect and H gradient in bulk La(Fe, Si) 13Hy magnetic refrigerants obtained by HDSH", Journal of Magnetism and Magnetic Materials, vol. 386, Jul. 1, 2015 (Jul. 1, 2015), pp. 125-128, XP055604478, Amsterdam, NL.

Teixeira C S et al: "A new feature of the reduction-diffusion process applied for the synthesis of magnetocaloric LaFe13-xSixcompounds", Journal of Alloys and Compounds, vol. 541, Jun. 16, 2012 (Jun. 16, 2012), pp. 84-87, XP028938082.

Extended European search report for European Patent Application No. 16857444.0 dated Jul. 18, 2019.

International Search Report for PCT/JP2016/080883 dated Dec. 27, 2016.

A. Takahashi-Saito, T. Kobayashi and H. Tsuji, Magnetic Refrigeration near Room Temperature, Magnetics Japan (MAGUNE) vol. 1, No. 7 (2006), p. 308-315.

* cited by examiner

METHOD OF MANUFACTURING MAGNETIC MATERIAL

BACKGROUND OF THE INVENTION

1. Field of the Invention

The present invention relates to a method of manufacturing a magnetic material.

2. Description of the Related Art

Recently, as a refrigeration technique for decreasing burden on the environment, a magnetic refrigeration method is suggested which is clean and has high energy efficiency, without using a flon (chlorofluorocarbon)-based gas, which induces environmental issues. A magnetic refrigeration material functions as a refrigerant in this magnetic refrigeration method, and in order to operate the magnetic refrigerator at room temperature, a magnetic material is used by which large magnetic entropy variation can be obtained near room temperature.

As a magnetic material that demonstrates preferable characteristics for such magnetic refrigeration, a La(Fe, Si)$_{13}$-based compound including a NaZn$_{13}$-type crystal structure is known. The La(Fe, Si)$_{13}$-based compound is practically advantageous because it can obtain large magnetic entropy variation, and also it uses low-priced Fe as a main structural element (see Patent Documents 1 and 2, for example).

As a method of manufacturing the La(Fe, Si)$_{13}$-based compound, it is reported that a magnetic material whose main phase is a NaZn$_{13}$-type crystal structure can be obtained by integrating source materials by an arc melting method or the like, and subsequently, performing a heat treatment of retaining the integrated materials at 1050° C. for 10 days (see Non-Patent Document 1).

However, when an arc melting method, a melting method using high frequency or the like is applied in synthesizing the La(Fe, Si)$_{13}$-based compound, at a stage when materials form an alloy via a liquid phase, a phase separation metal reaction, so-called a peritectic reaction, occurs. Thus, an intermediate-state material including a large amount of an α-Fe phase and a LaFeSi compound phase is inevitably generated, and the NaZn$_{13}$-type crystal structure is not generated almost at all in this intermediate material. Thus, in order to obtain the La(Fe, Si)$_{13}$-based compound from the intermediate material, a homogenizing heat treatment at high temperature for a long period is necessary, as described above.

In order to avoid such a heat treatment at high temperature for a long period, for example, Patent Document 3 suggests a method of solidifying by a roll-quenching method, and Patent Document 4 suggests a method of forced cooling a molten metal. Although the homogenizing heat treatment on the intermediate material may be shortened by these methods, it is still inevitable to pass through the intermediate material.

Further, Patent Document 5 describes that by containing boron B, carbon C or the like in a source material composition, a generating amount of a NaZn$_{13}$-type crystal structure in an intermediate material is increase and a homogenizing heat treatment thereafter is easily performed. However, for an alloy manufactured by this method, it is necessary to add approximately greater than or equal to 1.8 at % and less than or equal to 5.4 at % of B in order to obtain a good effect, and there is a problem that a sub-generated phase such as a Fe$_2$B phase may lower properties.

A method of obtaining a NaZn$_{13}$-type crystal structure in a final state without passing through an intermediate material is attempted by using a metal reaction which does not pass through a liquid phase. Patent Document 6 suggests a method of reacting a Fe—Si alloy and lanthanum oxide. However, as the La oxide is stable, in order to reduce the La oxide, it is necessary to use an alkali earth metal such as Ca, which is extremely active to oxygen, and safety control becomes complicated. Further, as water washing is essential in order to remove Ca oxide after the reaction, there is a risk that rust is generated at a surface of a generated La(Fe, Si)$_{13}$-based compound.

As a similar method of manufacturing by a solid phase reaction, Patent Document 7 suggests a method of sintering by applying electric current and heating by pressurizing and applying pulsed electric current at the same time. According to this method, it is possible to manufacture a sample including relatively a large amount of a La(Fe, Si)$_{13}$-based compound within a short period without passing through an intermediate material.

Patent Documents

Patent Document 1: Japanese Laid-open Patent Publication No. 2002-356748

Patent Document 2: Japanese Laid-open Patent Publication No. 2003-96547

Patent Document 3: Japanese Laid-open Patent Publication No. 2004-100043

Patent Document 4: Japanese Laid-open Patent Publication No. 2006-265631

Patent Document 5: Japanese Laid-open Patent Publication No. 2004-99928

Patent Document 6: Japanese Laid-open Patent Publication No. 2006-274345

Patent Document 7: Japanese Patent No. 4237730

Non-Patent Document

Non-Patent Document 1: "Magnetic Refrigeration Toward Application for Room Temperature" Magnetics Japan (MAGUNE) Vol. 1, No. 7 (2006), p 308-315.

However, according to the method of manufacturing the magnetic material disclosed in Patent Document 7, although the amount of the La(Fe, Si)$_{13}$-based compound obtained within a short period is large, an amount of remaining α-Fe is also large. Thus, compared with a case when the intermediate material is homogenized via a liquid phase, a volume fraction of the NaZn$_{13}$-type crystal structure is lowered and the Fe content in the La(Fe, Si)$_{13}$-based compound is reduced, and targeted magnetic entropy characteristics are lowered.

SUMMARY OF THE INVENTION

The present invention is made in light of the above problems, and according to an aspect of the invention, it is an object to provide a method of manufacturing a magnetic material, by a solid phase reaction, capable of obtaining a magnetic material whose fraction (content) of a NaZn$_{13}$-type crystal structure is high.

According to an embodiment, there is provided a method of manufacturing a magnetic material, including a surface oxides decreasing step of decreasing surface oxides of an iron powder; a powder-molded body forming step of mixing the iron powder whose surface oxides are already decreased obtained by the surface oxides decreasing step, and a compound powder "A" constituted by a La element and a Si element, and compressing and molding the obtained mixture powder; and a sintered body forming step of preparing a sintered body from the powder-molded body obtained by the powder-molded body forming step, by a solid phase reaction under vacuum atmosphere.

According to an aspect of the invention, a method of manufacturing a magnetic material, by a solid phase reaction, capable of obtaining a magnetic material whose fraction of a $NaZn_{13}$-type crystal structure is high can be provided.

DETAILED DESCRIPTION OF THE PREFERRED EMBODIMENTS

Figure 1:
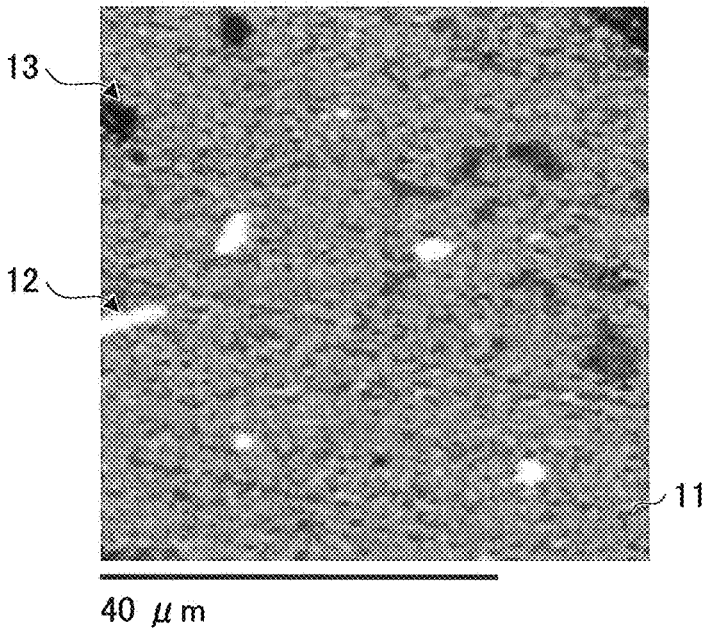
FIG. 1 is a reflected electron image of a magnetic material obtained in example 1 of the invention.

Although embodiments for performing the invention will be described in the following, it is to be noted that the present invention is not limited to the following embodiments, and that numerous variations and modifications may be made therein without departing from the spirit and scope of the invention.

An example of a method of manufacturing a magnetic material of an embodiment is described in the following.

The method of manufacturing the magnetic material of the embodiment may include following steps.

A surface oxides decreasing step of decreasing surface oxides of an iron powder.

A powder-molded body forming step of mixing an iron powder whose surface oxides are already decreased obtained by the surface oxides decreasing step, and a compound powder "A" constituted by an La element and a Si element, and compressing and molding the obtained mixture powder.

A sintered body forming step of forming a sintered body from the powder-molded body obtained by the powder-molded body forming step by a solid phase reaction under vacuum atmosphere.

Hereinafter, each step is described.

(Surface Oxides Decreasing Step)

The present inventors studied hard about a method of manufacturing a magnetic material, by a solid phase reaction, capable of obtaining a magnetic material whose fraction (content) of the $NaZn_{13}$-type crystal structure was high.

Then, present inventors targeted and studied on atmosphere when performing sintering and formation of La oxide in a solid phase reaction by starting source material powders, which were not conventionally noticed. Then, the present inventors found that a phenomenon that an oxygen atom mixed in as oxides formed at a surface of an iron powder, which was one of source powders, reacts with a La element in a reactive sintering process to form lanthanum oxide was the most critical inhibiting factor in a generation reaction of the $NaZn_{13}$-type crystal structure.

Thus, according to the method of manufacturing the magnetic material of the embodiment, the surface oxides decreasing step of decreasing and removing surface oxides of an iron powder, which is one of source powders, is provided.

In the surface oxides decreasing step, specific means to decrease the surface oxides of the iron powder are not specifically limited.

Specific examples of the surface oxides decreasing step are described in the following.

For example, as a first example of the surface oxides decreasing step, the surface oxides decreasing step may include following steps. By performing the following steps in the surface oxides decreasing step, surface oxides formed at a surface of an iron powder supplied as a starting source material is decreased and removed and an iron powder whose surface oxides are already decreased can be obtained.

An iron powder placing step of placing the iron powder in a heating chamber of an electric furnace.

After the iron powder placing step, an evacuation step of evacuating the heating chamber.

After the evacuation step, a surface reduction treatment step of heating the heating chamber to process temperature greater than or equal to 400° C. and less than or equal to 1000° C. and exposing the iron powder to hydrogen gas to perform a surface reduction treatment of the iron powder, and obtaining an iron powder whose surface oxides are already decreased.

In the iron powder placing step, the iron powder may be placed in the heating chamber of the electric furnace. Although the electric furnace used at this time is not specifically limited, it is preferable to use an electric furnace by which a heating chamber, in other words, a furnace can be evacuated and to which hydrogen gas can be supplied in order to perform the evacuation step and the surface reduction treatment step.

In the evacuation step, the heating chamber of the electric furnace may be evacuated. When performing the evacuation, ultimate pressure in the electric furnace is not specifically limited. For example, it is enough for the ultimate pressure to a degree capable of being evacuated by a rotary pump, for example, and it is preferable to be less than or equal to 1 Pa, and more preferably, less than or equal to $1.0\times10^{-1}$ Pa.

The surface reduction treatment step may be performed after reaching targeted pressure in the evacuation step. In the surface reduction treatment step, the heating chamber of the electric furnace may be heated to process temperature greater than or equal to 400° C. and less than or equal to 1000° C., and also hydrogen gas is supplied in the heating chamber of the electric furnace to reduce the surface of the iron powder by causing the iron powder to contact the hydrogen gas and the iron powder to be exposed to the hydrogen gas. With this, the surface oxides of the iron powder can be decreased.

As described above, it is preferable that the process temperature is greater than or equal to 400° C. and less than or equal to 1000° C., more preferably, greater than or equal to 500° C. and less than or equal to 700° C., and furthermore preferably, greater than or equal to 600° C. and less than or equal to 650° C.

This is because when the process temperature is less than 400° C., a reduction reaction does not sufficiently advance even when hydrogen gas is supplied, and there is a risk that an effect of decreasing the surface oxides of the iron powder cannot be sufficiently obtained.

Further, this is because when the process temperature exceeds 1000° C., the iron powders are sintered each other, and there is a risk that the particle size of the iron powder becomes rough and large.

Timing at which the hydrogen gas is supplied is not specifically limited, and for example, the hydrogen gas may be started to be supplied by switching from the evacuation when starting heating. However, if the heating chamber is still at low temperature, the reduction reaction does not sufficiently advance. Thus, it is preferable that the evacuation is continued until the heating chamber reaches the above described process temperature even after starting the heating, and the hydrogen gas is started to be supplied after reaching the process temperature.

The hydrogen gas to be supplied may be elementary gas of hydrogen molecule, but alternatively, may be mixed gas of hydrogen molecule and an inert element. As the inert element, for example, argon, helium or the like may be used. In particular, in order to sufficiently advance the reduction reaction for the surface oxides of the iron powder, it is preferable that the hydrogen gas to be supplied is the elementary gas of hydrogen molecule. When supplying the hydrogen gas, it is preferable that the pressure of the heating chamber of the electric furnace becomes atmospheric pressure.

A way of supplying the hydrogen gas after starting supplying of the hydrogen gas to the electric furnace is not specifically limited.

For example, after starting supplying of the hydrogen gas, the hydrogen gas may be continuously supplied in the electric furnace to form air flow of the hydrogen gas in the electric furnace.

Further, the hydrogen gas may be supplied until the pressure in the electric furnace becomes desired pressure, for example, atmospheric pressure, to make hydrogen containing atmosphere in the electric furnace, and thereafter, supplying of the hydrogen gas may be stopped. Even when supplying of the hydrogen gas is stopped once as such, the pressure in the electric furnace may be monitored and the hydrogen gas may be supplied again at any timing in accordance with variation of the pressure in the electric furnace.

A period while keeping the electric furnace to be the hydrogen containing atmosphere, and retaining the process temperature, in other words, a process period, is not specifically limited, and may be selectable in accordance with an amount of the iron powder placed in the electric furnace, a degree of formation of the surface oxides and the like. In particular, in order to sufficiently decrease the surface oxides at the surface of the iron powder, for example, it is preferable that the process period is greater than or equal to one hour. Although the upper limit of the process period is not specifically limited, it is preferable to be less than or equal to two hours considering productivity and the like.

After finishing the surface reduction treatment step, heating is stopped, and the electric furnace may be cooled to room temperature or near the room temperature. It is preferable that the electric furnace is kept under hydrogen gas containing atmosphere even after heating is stopped. This is to prevent the surface of the iron powder from being oxidized again while cooling to room temperature or near the room temperature.

After cooling to room temperature, or near room temperature, the iron powder on which the reduction treatment is performed, in other words, the iron powder whose surface oxides are already decreased may be taken out from the heating chamber, and may be supplied to the powder-molded body forming step, which will be described later.

A second example of the surface oxides decreasing step is described. The surface oxides decreasing step may include following steps. By performing the following steps in the surface oxides decreasing step, surface oxides formed at a surface of an electrolytic iron supplied as a starting source material is decreased and removed and an iron powder whose surface oxides are already decreased can be obtained.

An iron ingot forming step of forming an iron ingot by melting and degassing an electrolytic iron.

A grinding step of obtaining an iron powder whose surface oxides are already decreased by grinding the iron ingot obtained by the iron ingot forming step.

In the iron ingot forming step, the iron ingot may be formed by melting and degassing the electrolytic iron. Although a specific method of melting and degassing the electrolytic iron is not specifically limited, for example, the electrolytic iron may be melted and degassed by arc melting under argon atmosphere.

By performing the iron ingot forming step, the iron ingot in which the content of oxygen is decreased can be formed.

Then, by grinding the obtained iron ingot in the grinding step, the iron powder whose surface oxides are already decreased can be obtained. A method and a condition of grinding the iron ingot in the grinding step are not specifically limited, and the grinding step may be performed so that the iron powder whose surface oxides are already decreased with a desired particle size can be obtained. For example, the iron ingot may be grinded by a drill bit.

The iron powder whose surface oxides are already decreased obtained in the grinding step may be supplied to the powder-molded body forming step, which will be described later.

Although two examples of the surface oxides decreasing step are described above, a structure of the surface oxides decreasing step is not limited to the above described embodiments, and various methods may be used as long as the surface oxides of the iron powder can be decreased or removed.

Although the size of the iron powder whose surface oxides are already decreased supplied to the powder-molded body forming step, which will be described later, is not specifically limited, it is preferable that the iron powder whose surface oxides are already decreased is a powder that has passed a sieve with a reference size defined by JISZ8801 (1982) of 106 μm.

This is because it is preferable that the iron powder whose surface oxides are already decreased provided in the powder-molded body forming step has a particle size similar to the compound powder "A", which will be described later, when considering promotion of a solid phase reaction in performing the sintered body forming step after the powder-molded body forming step. As will be described later, as it is preferable that the compound powder "A" is a powder that has passed a sieve with a reference size defined by JISZ8801 (1982) of 106 μm, as described above, it is preferable that the iron powder whose surface oxides are already decreased used in the powder-molded body forming step is a powder that has passed a sieve with a reference size defined by JISZ8801 (1982) of 106 μm.

In particular, it is preferable that the iron powder whose surface oxides are already decreased supplied to the powder-molded body forming step, which will be described later, is the iron powder whose surface oxides are already decreased which has passed a sieve whose reference size defined by JISZ8801 (1982) is 53 μm, among the iron powders whose surface oxides are already decreased. Among them, it is furthermore preferable that iron powder whose surface oxides are already decreased supplied to the powder-molded body forming step, which will be described later, is the iron powder whose surface oxides are already decreased which has passed a sieve whose reference size defined by JISZ8801 (1982) is 32 μm, among the iron powders whose surface oxides are already decreased.

This is because, in the sintered body forming step, which will be described later, as the size of the powder influences on a diffusion length and speed of an element, in order to sufficiently advance a reaction in the sintered body forming step, by screening at least by a sieve with a reference size of 106 μm, rough and large particles can be removed. However, the iron powder obtained by screening by a sieve with a reference size smaller than the sieve with a reference size of 32 μm may include a large amount of a powder that causes an oxidation reaction that may cause ignition, and is not practically used.

Although it is preferable that the particle size of the iron powder whose surface oxides are already decreased obtained in the surface oxides decreasing step is a powder that has passed a sieve with a reference size defined by JISZ8801 (1982) of 106 μm, as described above, the particle size may be out of such a range right after the surface oxides reducing treatment is finished. In such a case, the iron powder whose surface oxides are already decreased after the surface oxides decreasing step may be screened by a sieve with a predetermined reference size so that the particle size is within the above described particle size range.

However, in order to omit an operation of screening, for example, among the two examples of the surface oxides decreasing step, for the first example, it is preferable that the iron powder supplied in the heating chamber of the electric furnace is constituted by a powder that can pass the sieve of the above described predetermined reference size. Further, for the second example of the above described surface oxides decreasing step, it is preferable that the iron ingot is grinded in the grinding step such that the iron powder whose surface oxides are already decreased with a particle size that can pass a sieve of a predetermined reference size is obtained.

(Powder-Molded Body Forming Step)

In the powder-molded body forming step, the iron powder whose surface oxides are already decreased obtained in the surface oxides decreasing step and the compound powder "A" of a LaSi compound constituted by a La element and a Si element may be mixed, and the obtained mixture powder may be compressed and molded to form a powder-molded body.

First, the compound powder "A" is described.

As described above, the compound powder "A" may be constituted by a La element and a Si element.

Such a compound powder "A" is obtained by, for example, weighing a powder of lanthanum only and a powder of silicon only such that a bulk material of a composition that matches ratios of La and Si in the mixture powder of the iron powder and the compound powder "A", thereafter melting and mixing it, and grinding the obtained bulk material. Here, depending on the composition, there is a case that the bulk material is constituted by a single compound, but the bulk material may be constituted by a plurality of compound phases.

As described above, the compound powder "A" may be formed into a powder form by once forming the bulk material, and then grinding the bulk material. As this time, although the size of the compound powder "A" is not specifically limited, for example, it is preferable that the compound powder "A" is a powder which has passed a sieve with a reference size defined by JISZ8801 (1982) of 106 μm, for example.

In the sintered body forming step, which will be described later, a sintered body of a magnetic material whose fraction of the $NaZn_{13}$-type crystal structure is high can be formed by a solid phase reaction. Then, as the size of the powder influences on a diffusion length and speed of an element, in order to sufficiently advance a reaction in the sintered body forming step, it is preferable that the compound powder "A" is a powder that has passed a sieve with a reference size defined by JISZ8801 (1982) of 106 μm.

In particular, it is preferable that the compound powder "A" is a powder, among the powders obtained by grinding the bulk material, that has passed a sieve with a reference size defined by JISZ8801 (1982) of 53 μm. It is more preferable that the compound powder "A" is a powder, among the powders obtained by grinding the bulk material, that has passed a sieve with a reference size defined by JISZ8801 (1982) of 32 μm.

This is because, in the sintered body forming step, which will be described later, as the size of the powder influences on a diffusion length and speed of an element, in order to sufficiently advance a reaction in the sintered body forming step, by screening at least by a sieve with a reference size of 106 μm, rough and large particles can be removed. However, the compound powder "A" obtained by screening by a sieve with a reference size smaller than the sieve with a reference size of 32 μm may include a large amount of a powder that causes an oxidation reaction that may cause ignition, and is not practically used.

Next, the mixture powder is described. As described above, in the powder-molded body forming step, the mixture powder may be prepared by weighing the iron powder whose surface oxides are already decreased and the compound powder "A" to be predetermined ratios, respectively, and mixing them. At this time, although the composition of the mixture powder is not specifically limited, it is preferable to mix such that the ratio of the La element is greater than or equal to 7.1 at % and less than or equal to 9.3 at %, the ratio of the Fe element is greater than or equal to 76.1 at % and less than or equal to 84.5 at %, and the ratio of the Si element is greater than or equal to 8.4 at % and less than or equal to 16.7 at %.

According to the method of manufacturing the magnetic material of the embodiment, a magnetic material whose fraction of the $NaZn_{13}$-type crystal structure is high can be manufactured. Further, as the $NaZn_{13}$-type crystal structure, the $La(Fe, Si)_{13}$-based compound can be preferably manufactured. Thus, it is preferable that the mixture powder is prepared such that ratios of the elements included in the mixture powder correspond to the targeted composition, respectively.

However, as there is a risk that La forms a slight amount of oxide in the sintered body forming step and the like, it is preferable for La to add more than the stoichiometric mixture ratio in the mixture. Thus, as described above, it is preferable that the ratio of the La element in the mixture powder is greater than or equal to 7.1 at %. However, if the ratio of the La element becomes too high, there is a risk that a phase that is different from a targeted phase is generated, it is preferable that the ratio of the La element in the mixture powder is less than or equal to 9.3 at %.

For the Fe element and the Si element, as a magnetocaloric effect becomes larger as the ratio of the Fe element included in the mixture powder and in the Si element becomes higher, as described above, it is preferable that the ratio of the Fe element is greater than or equal to 76.1 at %, and the ratio of the Si element is less than or equal to 16.7 at %. However, if the ratio of the Fe element becomes too high, among the Fe element and the Si element, an impurity phase is easily generated. Thus, as described above, it is preferable that the ratio of the Fe element is less than or equal to 84.5 at %, and the ratio of the Si element is greater than or equal to 8.4 at %.

In particular for the composition of the mixture powder, it is more preferable that the ratio of the La element is greater than or equal to 7.1 at % and less than or equal to 7.5 at %, it is more preferable that the ratio of the Fe element is greater than or equal to 81.5 at % and less than or equal to 83.0 at %, and it is more preferable that the ratio of the Si element is greater than or equal to 9.2 at % and less than or equal to 11.1 at %.

When preparing the mixture powder, a specific method of mixing the iron powder and the compound powder "A" is not specifically limited, and any methods may be used as long as both of the powders can be substantially uniformly mixed.

Then, in the powder-molded body forming step, a powder-molded body can be obtained by compressing and molding the mixture powder.

A method of the compressing and molding is not specifically limited, and the powder-molded body can be obtained by filling the mixture powder in a molding device and pressing it to be molded. Specifically, for example, a pellet-like powder-molded body may be obtained by inputting the mixture powder in a mold die, thereafter, blocking upper and lower portions by a punch, and applying load to the punch.

When molding, load (pressure) to be applied is not specifically limited. When the load is large, a percentage of voids in a sample after sintering can be decreased. However, if the load is too large, the punch and the die are plasticity deformed and the load cannot be uniformly dispersed. Thus, it is preferable to select the pressure in molding based on a material of the punch or the die, a percentage of voids required for the sintered body and the like.

(Sintered Body Forming Step)

In the sintered body forming step, a sintered body may be manufactured from the powder-molded body obtained by the powder-molded body forming step by a solid phase reaction under vacuum atmosphere.

In the sintered body forming step, specifically, for example, it is preferable that the powder-molded body is heated at temperature greater than or equal to 1050° C. and less than or equal to 1140° C. under vacuum to advance reactive sintering.

In the sintered body forming step, after placing the powder-molded body in the heating furnace, the chamber may be evacuated to be vacuum before starting heating. As such, by placing under an evacuated environment after detaching the powder-molded body from the die after molding in the powder-molded body forming step, remaining air included in the powder-molded body while molding the powder can be removed. This process cannot be actualized by electric current sintering in which pressurizing and heating are performed at the same time.

Further, according to the studies by the present inventors, in addition to decrease the surface oxides of the iron powder of the source material in the surface oxides decreasing step, by heating under an environment of vacuum atmosphere at which invasion of oxygen from outside of the sample is suppressed in the sintered body forming step, an effect of removing the surface oxides of the iron powder can be apparently obtained. This means that a generation reaction of the $NaZn_{13}$-type crystal structure can be promoted.

When evacuating the chamber, a degree of vacuum at room temperature is not specifically limited, and may be less than 0.1 MPa, which is atmospheric pressure, preferably, greater than or equal to $1\times10^{-3}$ Pa and less than or equal to $1\times10^{-1}$ Pa, and more preferably, greater than or equal to $5\times10^{-3}$ Pa and less than or equal to $1\times10^{-2}$ Pa.

As described above, as long as the chamber is evacuated to be lower than or equal to atmospheric pressure in the sintered body forming step, the degree of vacuum is not specifically limited. However, if the degree of vacuum exceeds $1\times10^{-1}$ Pa, there may be a case that oxygen or moisture remain in the chamber up to an amount that effects a sintering reaction. Thus, it is preferable that the degree of vacuum is less than or equal to $1\times10^{-1}$ Pa. Further, in order to actualize high vacuum less than $1\times10^{-3}$ Pa, a specific exhaust system that has high capability is necessary. Thus, it is preferable that the degree of vacuum is greater than or equal to $1\times10^{-3}$ Pa. In particular, it is practical for the ultimate pressure to be greater than or equal to $5\times10^{-3}$ Pa.

Although it is described that the chamber is evacuated to be vacuum, for example, the powder-molded body may be evacuated to be vacuum and sealed in a glass tube or the like, and may be heated. In such a case, when sealing the glass tube to be vacuum, the glass tube is evacuated and a degree of vacuum in the glass tube may be desirably set.

In the sintered body forming step, after setting the chamber to be the predetermined degree of vacuum, or while evacuating the chamber, heating may be stated and the powder-molded body may be heated. In order to sufficiently remove remaining air included in the powder-molded body, it is preferable to start heating after the chamber is evacuated to be the predetermined degree of vacuum.

Then, it is preferable that target temperature in heating, in other words, the heat treatment temperature is greater than or equal to 1050° C. and less than or equal to 1140° C., as already described.

As peritectic decomposition temperature is lowered as the concentration of Fe becomes high, in the $La(Fe, Si)_{13}$ compound, at an area where the concentration of Fe is higher than the composition ratio of Fe and Si is 0.91:0.09, the peritectic decomposition reaction occurs even at 1050° C., and at an area where the composition ratio of Fe and Si is near 0.88:0.12, the reaction is promoted when the temperature is risen up to 1140° C. and generation efficiency becomes good. Thus, as described above, the heat treatment temperature may be greater than or equal to 1050° C. and less than or equal to 1140° C., and in particular, the heat treatment temperature may be selected in accordance with the composition of the magnetic material to be prepared.

Then, by setting the heat treatment temperature to be greater than or equal to 1050° C. and less than or equal to 1140° C., a sintered body whose fraction of the $NaZn_{13}$-type crystal structure is high can be formed by the solid phase reaction. Thus, different from a case of forming via a liquid phase, generation of an intermediate material does not occur, it is unnecessary to perform a heat treatment for a long period, as a conventional method, and manufacturing efficiency of the $NaZn_{13}$-type crystal structure can be increased.

In the sintered body forming step, after reaching the heat treatment temperature, a period for retaining is not specifically limited, and may be freely selected in accordance with a size or the like of the powder-molded body. For example, the period may be selected by conducting a preliminary test or the like, and in accordance with a generation ratio of the $NaZn_{13}$-type crystal structure in the obtained sintered body.

Here, the type of the furnace when performing the sintered body forming step is not specifically limited, and any furnaces may be used as long as heating can be performed under reduced pressure atmosphere less than or equal to atmospheric pressure at desired temperature. For example, a method of heating under reduced pressure atmosphere less than or equal to atmospheric pressure may be performed by a heat treatment furnace in which a reactor core tube can be evacuated, and further, as already described, may be performed by sealing the powder-molded body in the evacuated quartz tube and retaining at a soaking zone of a tubular furnace or the like for a predetermined period.

As such, by decreasing the oxygen originated from the surface oxides of the iron powder of the source material included in the powder-molded body, and advancing the reactive sintering under vacuum, the generation ratio of the $NaZn_{13}$-type crystal structure can be efficiently increased within a short period. Thus, manufacturing efficiency of a magnetic material that demonstrates good properties as a magnetic refrigeration material can be increased.

Here, when only considering a magnetocaloric effect as the magnetic refrigeration material, it is preferable that the ratio of the $NaZn_{13}$-type crystal structure is close to 100%. However, if the reaction is once stopped at a state in which less than or equal to 10% volume fraction of an $\alpha$-Fe phase is included, machinability and the like that are practical characteristics for the magnetic material can be increased. Thus, the magnetic material can be formed into various shapes for mounting it on a system. Thus, the sintered body obtained in the sintered body forming step may include a second phase as long as its amount is small such as a volume fraction of less than or equal to 10%.

EXAMPLES

Although specific examples are described in the following, the present invention is limited to these examples.

Example 1

A magnetic material was prepared and evaluated by the following steps.

(Surface Oxides Decreasing Step)

100 g of a commercially available iron powder (manufactured by Kojundo Chemical Lab. Co., Ltd, less than or equal to 53 μm of particle size, and purity 3N) was spread on an alumina plate whose diameter was 8 cm, and was placed on a soaking zone of a heating chamber of an electric furnace (iron powder placing step).

Next, the heating chamber of the electric furnace was evacuated to $1\times10^{-1}$ Pa by a rotary pump (evacuation step).

After the degree of vacuum in the heating chamber became $1\times10^{-1}$ Pa, heating was started and temperature was risen to target temperature of 600° C. by elapsed time of one hour from the start of the heating. After reaching the target temperature, hydrogen was introduced under a condition by which the heating chamber became the same as atmospheric pressure, and the iron powder provided in the heating chamber was exposed to the hydrogen gas for an hour (surface reduction treatment step). After the supplying of the hydrogen gas is started, the hydrogen gas was continuously supplied while performing the surface reduction treatment step so that the pressure of the heating chamber was kept at the same as atmospheric pressure.

After finishing the surface reduction treatment step, while continuously introducing the hydrogen gas into the heating chamber, a heater of the electric furnace was switched off, and when the temperature of the heating chamber was lowered to room temperature, supplying of the hydrogen into the chamber was stopped, and an iron powder whose surface oxides were decreased (iron powder whose surface oxides were already decreased) was collected.

In order to remove a powder that was accidentally formed rough and large by sintering or the like from the obtained iron powder, the iron powder was screened by a standard sieve with a reference size defined by JISZ8801 (1982) of 53 μm, and only the powder that had passed the meshes was used as the iron powder whose surface oxides were already decreased in the powder-molded body forming step (Powder-molded body forming step).

First, the compound powder "A" was prepared. As the compound powder "A", a LaSi compound powder containing La and Si with a composition ratio of 1:1 was prepared by the following steps.

The LaSi compound powder was obtained by weighing a La metal (manufactured by Nippon Yttrium Co., Ltd.) and a Si powder (manufactured by Kojundo Chemical Lab. Co., Ltd., purity 4N) to be an amount-of-substance ratio of 1:1, manufacturing the LaSi compound by arc melting, and grinding the LaSi compound by an agate mortar and a pestle in atmosphere. The obtained LaSi compound powder was screened by a standard sieve with a reference size defined by JISZ8801 (1982) of 32 μm, and only the powder that had passed the meshes was used as the compound powder "A".

A mixture powder was prepared by mixing the iron powder whose surface oxides were already decreased obtained in the surface oxides decreasing step and the above described compound powder "A" to be a composition ratio of $La_{1+d}(Fe_{0.90}Si_{0.10})_{13}$. Here, an excess "d" for La from a stoichiometric ratio was set to be 0.3. This is to adjust an amount of the element sufficient enough to constitute $La(Fe_{0.90}Si_{0.10})_{13}$ even when inevitable La oxide was generated.

0.3 g of the obtained mixture powder was introduced in a through-hole (diameter: 8 mm) of a die made of nonmagnetic steel, blocked by a punch made of the same steel from upper and lower sides, and a pellet as the powder-molded body was manufactured by applying surface pressure corresponding to 100 MPa by hand-operated press from both ends.

(Sintered Body Forming Step)

After wrapping the pellet obtained in the powder-molded body forming step by a Mo foil with a thickness of 0.05 mm and introducing it in a quartz tube whose one end was closed, the quartz tube was evacuated to $5\times10^{-3}$ Pa, and the evacuated side was sealed and cut to form a vacuum ampule.

The manufactured vacuum ampule was placed in a muffle furnace, and after rising temperature to 1130° C., which is the heat treatment temperature for performing the reactive sintering, by two hours from starting the rising of the temperature, the vacuum ampule was retained at the heat treatment temperature for 12 hours.

After retaining for 12 hours, power supply for heating the furnace was stopped, and the furnace was cooled in accordance with self-cooling of the furnace. The outside quartz tube of the ampule taken out from the furnace was grinded, and a sintered magnetic material was obtained.

In order to examine compound phases in the obtained magnetic material, the surface was polished and a reflected electron image of a scanning electron microscope SEM (manufactured by Hitachi High-Technologies Corporation, model type: TM3000) was observed. The observed image is illustrated in FIG. 1.

The composition of a grey portion 11 in FIG. 1 was analyzed by using a SEM attached energy-dispersive X-ray spectroscopy (manufactured by Bruker, model type: Quantax 700). The composition ratios of La, Fe and Si matched $La(Fe_{0.9}Si_{0.1})_{13}$, and it was identified as the $NaZn_{13}$-type crystal structure.

A white portion 12 was a La rich phase and a black portion 13 was a Fe phase. As can be apparent from FIG. 1, the $NaZn_{13}$-type crystal structure was generated as the main phase, and it was confirmed that the size of the Fe phase was largely decreased compared from 53 μm of the iron powder which was used as the starting source material powder.

Example 2

A magnetic material was manufactured similarly as example 1 except that the surface oxides decreasing step was performed by the following steps and the obtained iron powder whose surface oxides were already decreased was used, in other words, the magnetic material was manufactured similarly as the powder-molded body forming step and the sintered body forming step of example 1 except the surface oxides decreasing step.

(Surface Oxides Decreasing Step)

First, 15 g of a commercially available electrolytic iron (manufactured by Showa Denko K.K., product name: Atomiron) was melted and degassed by arc melting in argon, and a button-shaped ingot was formed (iron ingot forming step).

Next, a drill bit on which industrial diamond was baked was attached to a driller, and the button-shaped ingot formed by the iron ingot forming step was grinded (grinding step).

The obtained grinded grain was screened by a standard sieve with a reference size defined by JISZ8801 (1982) of 53 μm, and only a powder that had passed meshes was used as the iron powder whose surface oxides were already decreased in the powder-molded body forming step.

Then, in order to examine compound phases in the obtained magnetic material, similar to example 1, the surface was polished and a reflected electron image of a scanning electron microscope was observed. The observed image is illustrated in FIG. 2.

Figure 2:
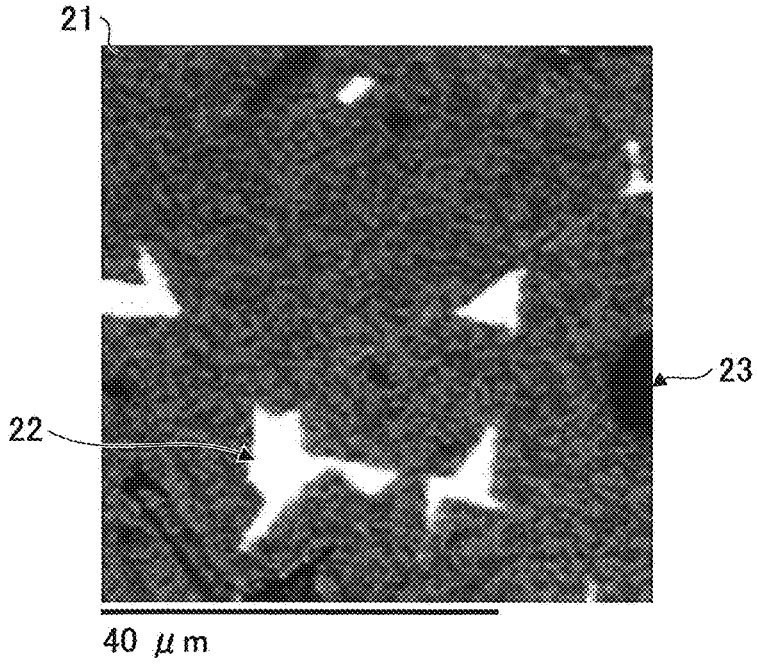
FIG. 2 is a reflected electron image of a magnetic material obtained in example 2 of the invention.

Similarly as example 1, the composition of a grey portion 21 in FIG. 2 was analyzed using the energy-dispersive X-ray spectroscopy. The composition ratios of La, Fe and Si matched $La(Fe_{0.9}Si_{0.1})_{13}$, and it was identified as the $NaZn_{13}$-type crystal structure.

A white portion 22 was a La rich phase and a black portion 23 was a Fe phase. It was confirmed that the residual Fe phase was little and almost all was the $NaZn_{13}$-type crystal structure in FIG. 2.

Figure 3:
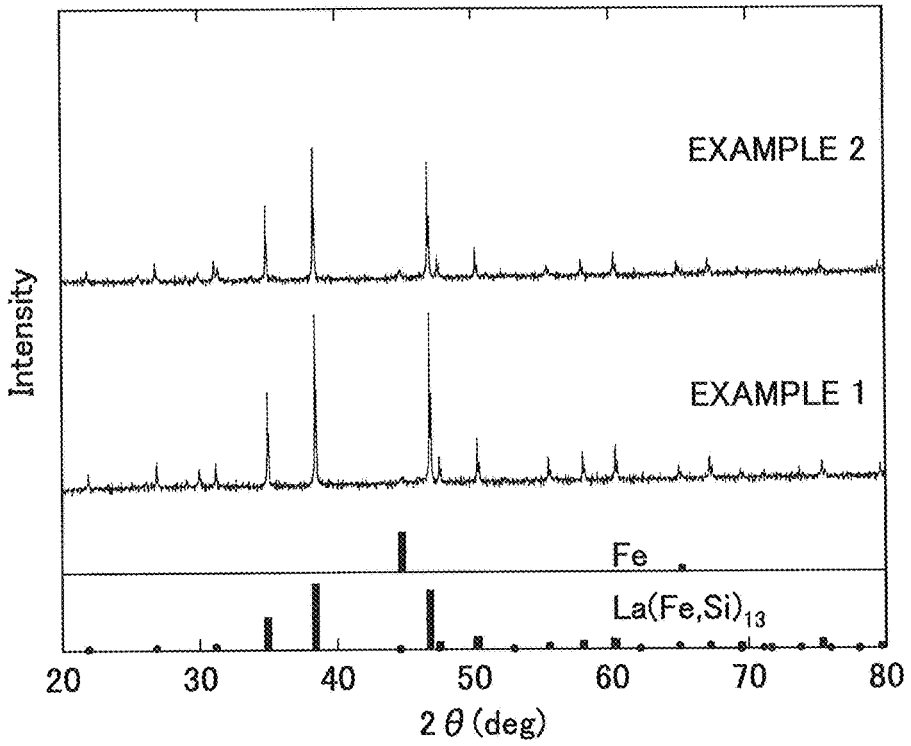
FIG. 3 is a measurement result of powder X-ray diffractometry of the magnetic material obtained in each of examples 1 and 2 of the invention.

In order to compare structural amounts of the Fe phase and the $NaZn_{13}$-type crystal structure, results of powder X-ray diffractometry for the samples obtained by example 1 and example 2 are illustrated in FIG. 3.

Bar charts illustrated at middle and lower portions of FIG. 3 indicate model pattern diagrams calculated from crystalline structures of $NaZn_{13}$-type $La(Fe, Si)_{13}$ and α-Fe.

From a result illustrated in FIG. 3, it can be confirmed that the $La(Fe, Si)_{13}$ phase is apparently formed more than the α-Fe phase in both of example 1 and example 2. When analyzing in detail, a ratio of phase fractions of $La(Fe, Si)_{13}$ and α-Fe is 99.0:1.0 in example 1, and 97.7:2.3 in example 2. It was confirmed that extremely good $NaZn_{13}$-type $La(Fe, Si)_{13}$ was manufactured.

Comparative Example 1

A test piece 1 was prepared similarly as example 1 except that the iron powder (manufactured by Kojundo Chemical Lab. Co., Ltd, less than or equal to 53 μm of particle size, purity 3N) was supplied in the powder-molded body forming step, without performing the surface oxides decreasing step, and except that the sintering was performed by sintering by applying current and pressure in the sintered body forming step.

Here, the sintered body forming step was performed such that a degree of vacuum in the chamber before sintering was $2\times10^{-2}$ Pa, applied pressure was 38 MPa, 300 A of current was flowed to a sample space whose cross-sectional area was a diameter of 10 mm, heated to 1120° C., and a current amount was set to be zero immediately after reaching the maximum temperature to stop the heating.

Figure 4:
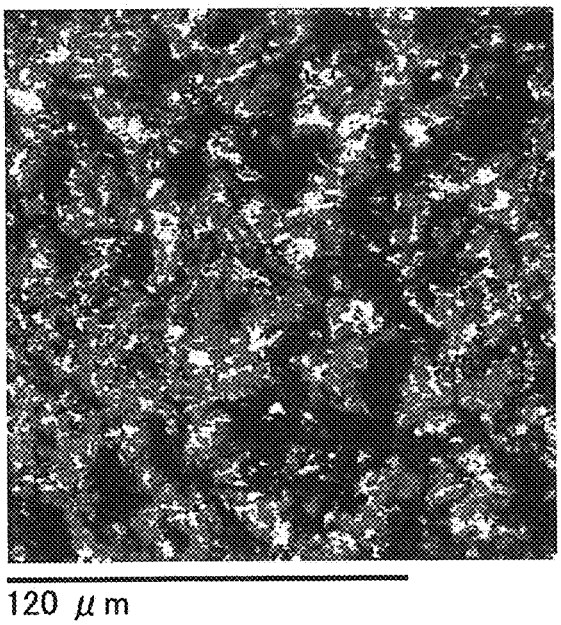
FIG. 4 is a reflected electron image of a magnetic material obtained in comparative example 1.
Figure 5:
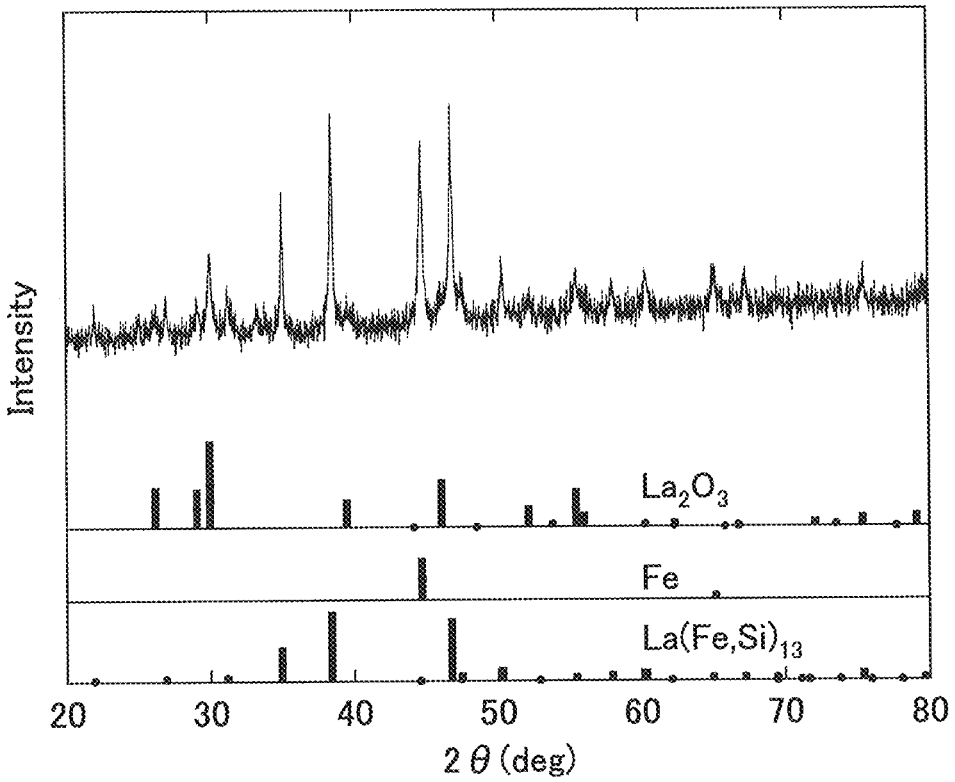
FIG. 5 is a measurement result of powder X-ray diffractometry of the magnetic material obtained in comparative example 1.

Results of SEM observation and powder X-ray diffractometry on the obtained test piece 1, similarly as example 1, are respectively illustrated in FIG. 4 and FIG. 5.

Although types of phases in the image of FIG. 4 were the same as those of example 1 and example 2, it can be understood that an amount of the black α-Fe phase is much with respect to the grey $NaZn_{13}$-type crystal structure, compared with the cases of example 1 and example 2.

An apparent peak of α-Fe was observed in a powder X-ray diffractometric pattern of FIG. 5, and a ratio of phase fractions of $La(Fe, Si)_{13}$ and α-Fe was 72.7:27.3. A percentage of contained La oxide was 24.0%.

This means that although the $NaZn_{13}$-type crystal structure was generated, a large amount of the α-Fe phase was left, compared with example 1. Further, characteristically, a diffraction peak that indicates an existence of La oxide was strongly observed. This indicates that a large amount of residual Fe was generated because if LaSi was oxidized to be $La_2O_3$, that could not contribute to a reaction to $La(Fe, Si)_{13}$.

Comparative Example 2

In comparative example 2, a test piece 2 was prepared similarly as example 1 except that the iron powder (manufactured by Kojundo Chemical Lab. Co., Ltd, less than or equal to 53 μm of particle size, purity 3N), same as that of example 1, was supplied in the powder-molded body forming step, without performing the surface oxides decreasing step, and except that the retention time after reaching the heat treatment temperature of 1130° C. was 48 hours in the sintered body forming step.

Figure 6:
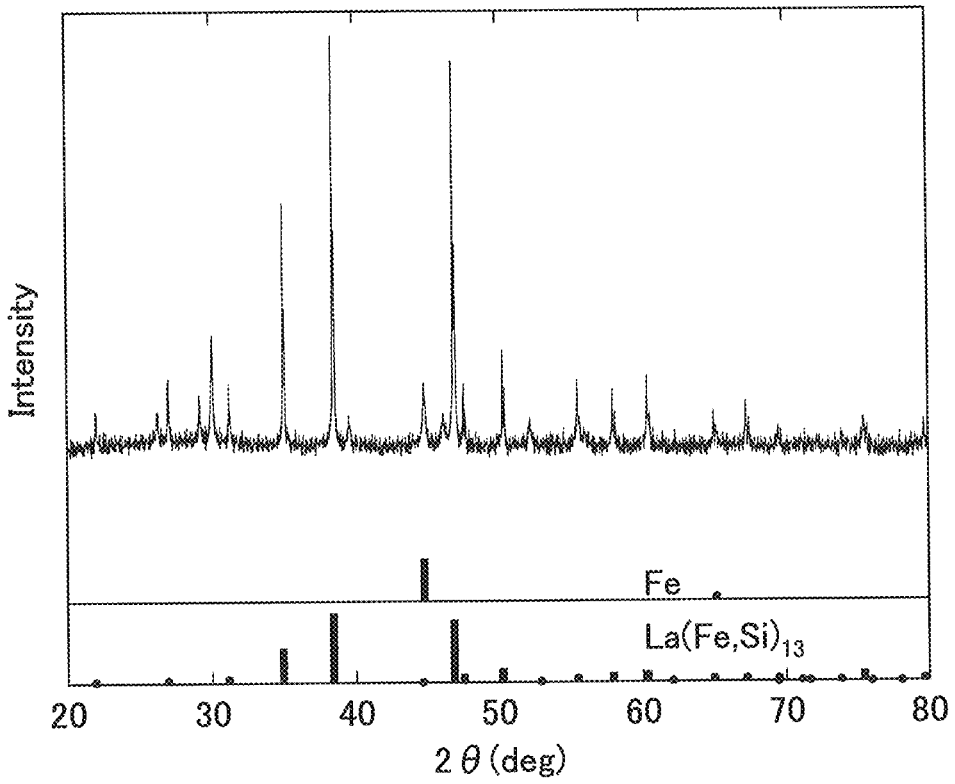
FIG. 6 is a measurement result of powder X-ray diffractometry of a magnetic material obtained in comparative example 2.

A result of powder X-ray diffractometry on the obtained test piece 2 is illustrated in FIG. 6. By comparing with the test piece 1, the residual Fe is decreased, and a ratio of the phase fractions of $La(Fe, Si)_{13}$ and α-Fe was 92.7:7.3.

Thus, it was confirmed that residual atmosphere in the powder can be evacuated and a degree of oxidation can be lowered by performing the reactive sintering by retaining the pellet formed from the mixture powder under vacuum, compared with the sintering by applying current and pressure described in comparative example 1. However, existence fraction of the residual Fe is 2.3 times or 7 times, compared with example 1 or example 2, and it was also confirmed that the generation ratio of $La(Fe, Si)_{13}$ that is actualized by the present invention cannot be accomplished only by the sintering under vacuum atmosphere.

Figure 7:
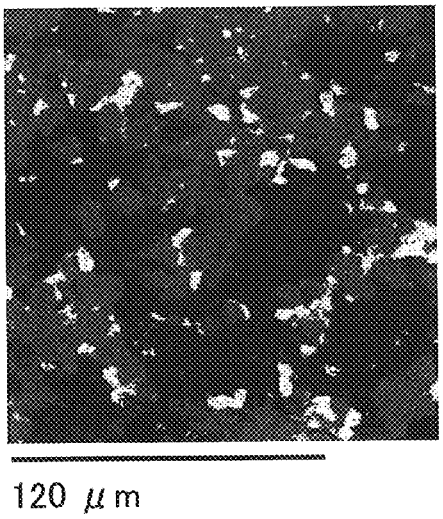
FIG. 7 is a reflected electron image of the magnetic material obtained in comparative example 2.

Further, a SEM image of the test piece 2 is illustrated in FIG. 7. It is indicated that organizations of the black α-Fe phase partially became rough and large to be greater than or equal to 53 μm, with respect to the white La rich phase, and growth of the Fe grain is generated. It can be explained, as a reason of such variation, that diffusion of elements between the LaSi grain and the Fe grain does not occur because the oxide layer around the Fe grain functions as a barrier, and meantime, the Fe grain becomes rough and large by a so-called Ostwald growth mechanism.

Comparative Example 3

In comparative example 3, a test piece 3 was prepared similarly as example 1 except that a quartz tube was not sealed and the quartz tube was heated under atmosphere in the sintered body forming step.

Figure 8:
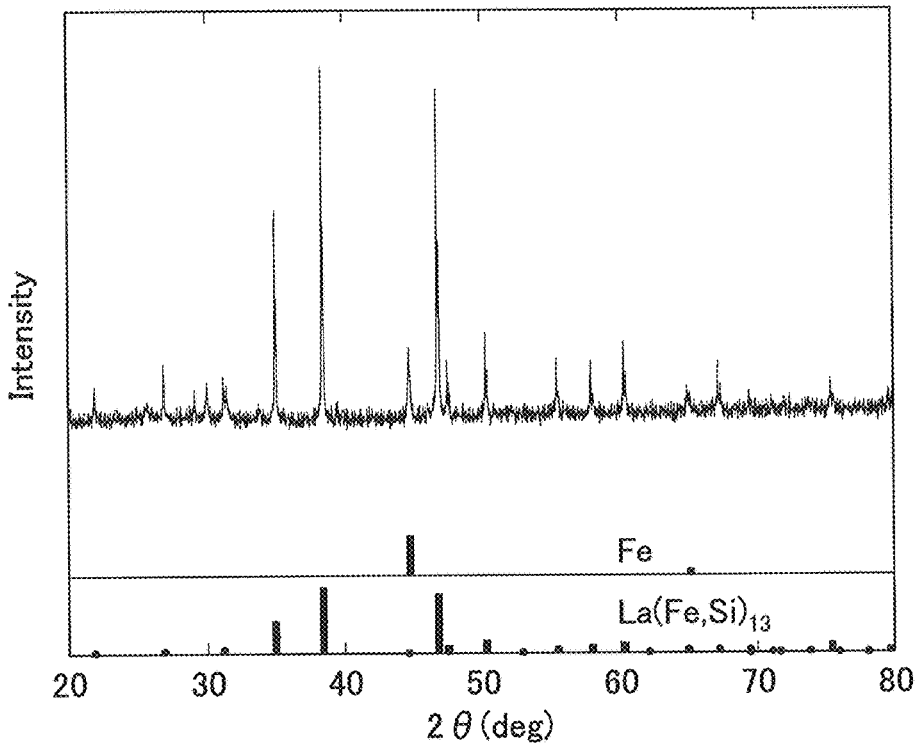
FIG. 8 is a measurement result of powder X-ray diffractometry of a magnetic material obtained in comparative example 3.
Figure 9:
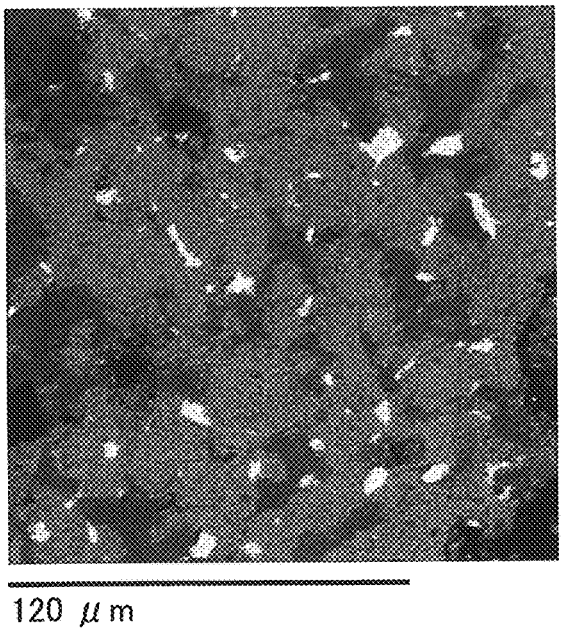
FIG. 9 is a reflected electron image of the magnetic material obtained in comparative example 3.

A result obtained by powder X-ray diffractometry measurement on the test piece 3 is illustrated in FIG. 8. FIG. 9 illustrates a SEM image of the test piece 3.

In the result of the powder X-ray diffractometry measurement illustrated in FIG. 8, compared with the test piece 2, almost the same amount of the residual Fe exists. However, according to the SEM image illustrated in FIG. 9, it can be understood that organizations of the black α-Fe phase did not become rough and large, with respect to the grey $NaZn_{13}$-type crystal structure and the white La rich phase. Thus, it was confirmed that although oxidation of a La compound originated from Fe oxide can be suppressed by reducing the surface of Fe, as oxygen was invaded from external atmosphere while the reactive sintering was advanced, La was oxidized before the reaction was completed by oxygen invaded from outside, and a reaction to form $La(Fe, Si)_{13}$ was inhibited in this case as well.

Although embodiments, examples and the like of the method of manufacturing a magnetic material have been specifically illustrated and described above, it is to be understood that the present invention is not limited to the above described embodiments, examples and the like. Numerous variations and modifications may be made therein without departing from the spirit and scope of the invention as defined by the claims.

The present application is based on and claims the benefit of priority of Japanese Priority Application No. 2015-205863 filed on Oct. 19, 2015, the entire contents of which are hereby incorporated by reference.

What is claimed is:

1. A method of manufacturing a magnetic material, comprising:

a surface oxides decreasing step of decreasing surface oxides of an iron powder;

a powder-molded body forming step of mixing the iron powder whose surface oxides are already decreased obtained by the surface oxides decreasing step, and a compound powder "A" constituted by a La element and a Si element, and compressing and molding the obtained mixture powder; and a sintered body forming step of preparing a sintered body from the powder-molded body obtained by the powder-molded body forming step, by a solid phase reaction under vacuum atmosphere, wherein the surface oxides decreasing step includes an iron powder placing step of placing the iron powder in a heating chamber of an electric furnace, an evacuation step of evacuating the heating chamber to be vacuum, after the iron powder placing step, and after the evacuation step, a surface reduction treatment step of performing a surface reduction treatment of the iron powder by heating the heating chamber to process temperature greater than or equal to 600° C. and less than or equal to 650° C., and also exposing the iron powder to hydrogen gas to obtain the iron powder whose surface oxides are already decreased.

2. The method of manufacturing a magnetic material according to claim 1, wherein in the powder-molded body forming step, the iron powder whose surface oxides are already decreased and the compound powder "A" are mixed such that, in the mixture powder, the ratio of the La element is greater than or equal to 7.1 at % and less than or equal to 9.3 at %, the ratio of the Fe element is greater than or equal to 76.1 at % and less than or equal to 84.5 at %, and the ratio of the Si element is greater than or equal to 8.4 at % and less than or equal to 16.7 at %.

3. A method of manufacturing a magnetic material comprising:

an iron ingot forming step of forming an iron ingot by melting and degassing electrolytic iron;

a grinding step of grinding the iron ingot obtained by the iron ingot forming step to obtain an iron powder whose surface oxides are decreased;

a powder-molded body forming step of mixing the iron powder whose surface oxides are decreased, and a compound powder "A" constituted by a La element and a Si element, and compressing and molding the obtained mixture powder; and a sintered body forming step of preparing a sintered body from the powder-molded body obtained by the powder-molded body forming step, by a solid phase reaction under vacuum atmosphere.

* * * * *